US009303304B2

(12) United States Patent
Longenberger

(10) Patent No.: US 9,303,304 B2
(45) Date of Patent: Apr. 5, 2016

(54) PROCESS FOR THE CREATION OF UNIFORM GRAIN SIZE IN HOT WORKED SPINODAL ALLOY

(71) Applicant: Materion Corporation, Mayfield Heights, OH (US)

(72) Inventor: Edward Longenberger, Perrysburg, OH (US)

(73) Assignee: Materion Corporation, Mayfield Heights, OH (US)

( * ) Notice: Subject to any disclaimer, the term of this patent is extended or adjusted under 35 U.S.C. 154(b) by 262 days.

(21) Appl. No.: 14/206,312

(22) Filed: Mar. 12, 2014

(65) Prior Publication Data

US 2014/0261923 A1 Sep. 18, 2014

Related U.S. Application Data

(60) Provisional application No. 61/793,690, filed on Mar. 15, 2013.

(51) Int. Cl.

| | |
|---|---|
| ***C22F 1/08*** | (2006.01) |
| ***C22C 9/00*** | (2006.01) |
| ***C22C 9/06*** | (2006.01) |

(52) U.S. Cl.
CPC ... *C22F 1/08* (2013.01); *C22C 9/00* (2013.01); *C22C 9/06* (2013.01)

(58) Field of Classification Search
CPC ..... C22F 1/08
See application file for complete search history.

(56) References Cited

U.S. PATENT DOCUMENTS

| | | | |
|---|---|---|---|
| 3,898,109 | A | 8/1975 | Shaw |
| 4,373,970 | A | 2/1983 | Scorey et al. |
| 4,512,817 | A | 4/1985 | Duhl et al. |
| 5,059,257 | A | 10/1991 | Wanner et al. |
| 6,332,906 | B1 | 12/2001 | Haynes et al. |
| 6,436,205 | B1 | 8/2002 | Behrens et al. |
| 2001/0009168 | A1 | 7/2001 | Bhargava |

OTHER PUBLICATIONS

International Search Report and Written Opinion for PCT Application No. PCT/US2014/024448 dated Jun. 20, 2014.

*Primary Examiner* — Veronica F Faison
(74) *Attorney, Agent, or Firm* — Richard M. Klein; Fay Sharpe LLP

(57) ABSTRACT

Processes for producing a uniform grain hot worked spinodal alloy are disclosed. The processes generate a uniform grain spinodal alloy without cracking and without the need for a homogenization step. The processes include providing an as-cast spinodal alloy, heating the as-cast spinodal alloy between 1200 and 1300° F. for approximately 12 hours and hot working, allowing the spinodal alloy to cool, performing a second hot work on the as-cast spinodal alloy after it has been heated to 1700° F. for a defined time period, exposing the alloy to a third temperature, performing a second hot work reduction, and cooling the alloy again.

20 Claims, 7 Drawing Sheets

PROCESS FOR THE CREATION OF UNIFORM GRAIN SIZE IN HOT WORKED SPINODAL ALLOY

CROSS-REFERENCE TO RELATED APPLICATION

This application claims priority to U.S. Provisional Patent Application Ser. No. 61/793,690, filed on Mar. 15, 2013, the contents of which are fully incorporated by reference herein.

BACKGROUND

The present disclosure relates to processes for producing uniform grain size hot-worked Cu—Ni—Sn spinodal alloys. Generally, the process may be used for creating spinodal alloys of uniform grain size without undergoing a homogenization step and without cracking. In lieu of a homogenization step, as-cast metal alloys are subject to particular heat treatment steps to produce spinodal alloys of uniform grain size.

Processes for creating metal alloys of uniform grain size traditionally include a homogenization step combined with other heat treatment and/or cold working steps. Homogenization is a generic term generally used to describe a heat treatment designed to correct microscopic deficiencies in the distribution of solute elements and modification of intermetallic structures present at the interfaces. One acceptable result of the homogenization process is that the elemental distribution of an as-cast metal becomes more uniform. Another result includes the formation of large intermetallic particles which form during casting and may be fractured and removed during heat-up.

Homogenization procedures are normally required prior to performing cold rolling or other hot working procedures in order to convert a metal into a more usable form and/or to improve the final properties of the rolled product. Homogenization is carried out to equilibrate microscopic concentration gradients. Homogenization is normally performed by heating the casting to an elevated temperature (above a transition temperature, typically near its melting point) for a few hours up to several days, with no mechanical working performed on the casting, and then cooling back to ambient temperature.

The need for the homogenization step is the result of microstructure deficiencies found in the cast product resulting from early stages or final stages of solidification. Such deficiencies include non-uniform grain size and chemical segregation. Post-solidification cracks are caused by macroscopic stresses that develop during casting, which cause cracks to form in a trans-granular manner before solidification is complete. Pre-solidification cracks are also caused by macroscopic stresses that develop during casting.

Traditional processes of producing uniform grain size have recognized limitations. Primarily, they generally require a homogenization step, which can cause unneeded macroscopic stresses that promote cracking.

It would be desirable to provide processes for generating spinodal alloys of uniform grain size without performing a homogenization step. Such methods would be would be advantageous as they lessen the chance for macroscopic stresses and cracking to occur in spinodal alloys.

BRIEF DESCRIPTION

The present disclosure relates to methods for converting an as-cast spinodal alloy to a wrought product of uniform grain size. Generally, no homogenization step is needed. Very broadly, a casting of the alloy is heated, then hot worked, then air cooled to room temperature. This heating-hot working-air cooling is repeated. The resulting workpiece has a uniform grain size. It was unexpectedly found that an alloy with a high solute content does not require a separate thermal homogenization treatment, and that mechanical working at a lower temperature prior to mechanical working at a higher temperature results in a uniform grain structure.

Disclosed in various embodiments herein are processes for producing an article comprising, in sequence: heating a casting to a first temperature of from about 1100° F. to about 1400° F. for a first time period of from about 10 hours to about 14 hours, the casting comprising a spinodal alloy; performing a first hot work reduction of the casting; air cooling the casting to a first ambient temperature; heating the casting to a second temperature of at least 1600° F. for a second time period; exposing the casting to a third temperature for a third time period; performing a second hot work reduction of the casting; and air cooling the casting to a final ambient temperature to produce the article. No homogenization step is needed.

In some embodiments, the third temperature is least about 50° F. greater than the second temperature, and the third time period is from about 2 hours to about 6 hours.

In other embodiments, the third temperature is least about 50° F. lower than the second temperature, and the third time period is from about 2 hours to about 6 hours, and the casting is air cooled from the second temperature down to the third temperature.

The second temperature may be from 1600° F. to about 1800° F. The second time period may be from about 12 hours to about 48 hours.

The third temperature can be from about 1600° F. to about 1750° F. The third time period can be about 4 hours.

The first ambient temperature and the second ambient temperature are generally room temperature, i.e. 23° C.-25° C.

The as-cast spinodal alloy is usually a copper-nickel-tin alloy. The copper-nickel-tin alloy may comprise from about 8 to about 20 wt % nickel and from about 5 to about 11 wt % tin, with the balance being copper. In more particular embodiments, the copper-nickel-tin as-cast spinodal alloy comprises from about 8 to about 10 wt % nickel and from about 5 to about 8 wt % tin.

The first hot work reduction can reduce the area of the casting by at least 30%. Similarly, the second first hot work reduction can reduce the area of the casting by at least 30%.

The first temperature can be from about 1200° F. to about 1350° F. The second temperature can be from about 1650° F. to about 1750° F.

In particular embodiments, the first time period is about 12 hours; and the first temperature is about 1350° F. In other embodiments, the second time period is about 24 hours; and the second temperature is about 1700° F.

Also disclosed is a process (S100) for producing a spinodal alloy with uniform grain size, comprising: heating an as-cast spinodal alloy between 1300° F. and 1400° F. for approximately 12 hours and then hot work reducing the alloy; air cooling the spinodal alloy; heating the spinodal alloy to about 1700° F. for a time period of about 12 hours to about 48 hours; heating the spinodal alloy to about 1750° F. for about 4 hours; performing a hot work reduction; and air cooling the spinodal alloy to produce the spinodal alloy with uniform grain size.

Also disclosed is a process (S200) for producing a spinodal alloy with uniform grain size, comprising: heating an as-cast spinodal alloy between 1300° F. and 1400° F. for approximately 12 hours and then hot work reducing the alloy; air cooling the spinodal alloy; heating the spinodal alloy to about 1700° F. for a time period of about 12 hours to about 48 hours;

furnace cooling the spinodal alloy to about 1600° F. and heating for about 4 hours; performing a hot work reduction; and air cooling the spinodal alloy to produce the spinodal alloy with uniform grain size.

These and other non-limiting characteristics of the present disclosure are more fully discussed below

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
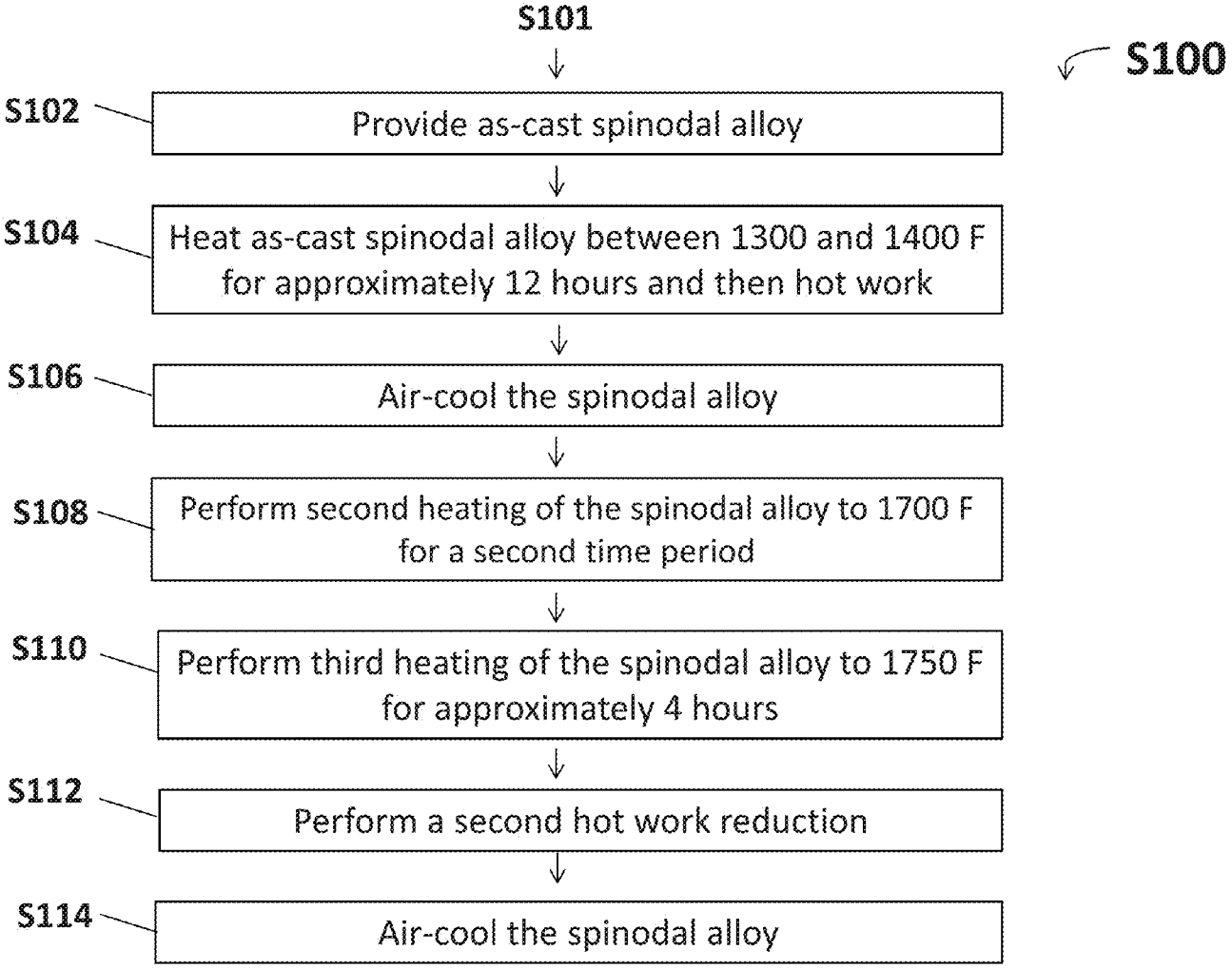
FIG. 1 is a flow chart for a first exemplary process of producing a hot worked spinodal alloy of uniform grain size.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

As used herein, the term "spinodal alloy" refers to an alloy whose chemical composition is such that it is capable of undergoing spinodal decomposition. The term "spinodal alloy" refers to alloy chemistry, not physical state. Therefore, a "spinodal alloy" may or may not have undergone spinodal decomposition and may or not be in the process of undergoing spinodal decomposition.

Spinodal aging/decomposition is a mechanism by which multiple components can separate into distinct regions or microstructures with different chemical compositions and physical properties. In particular, crystals with bulk composition in the central region of a phase diagram undergo exsolution.

Conventional processing steps for spinodal alloys include homogenization and hot working at elevated temperatures. These processes start at high temperatures and cascade downwards through lower temperatures as the material is processed. Heterogeneous microstructures generally result from these processes. Uniform microstructures are generally desired, as this indicates uniform properties throughout the alloy. Obtaining uniform microstructures can be difficult in spinodal alloys that can have multiple phases present. The present disclosure relates to processes for converting an as-cast spinodal alloy into a wrought product of uniform grain size.

With reference to FIG. 1, an exemplary process (S100) of producing spinodal alloy with uniform grain size by hot working according to a first embodiment starts at S101. At S102, an as-cast spinodal alloy is provided. At S104, the as-cast spinodal alloy is heated to a first temperature between 1300° F. and 1400° F. for approximately 12 hours and then hot worked. At S106, the spinodal alloy is air-cooled. At S108, the spinodal alloy is heated a second time to a second temperature of 1700° F. for a second time period. At S110, the spinodal alloy is heated to a higher third temperature of 1750° F. for approximately 4 hours. At S112, a second hot work reduction is performed. At S114, the spinodal alloy is air-cooled. A spinodal alloy with uniform grain size is formed without cracks and without homogenization being performed.

Figure 2:
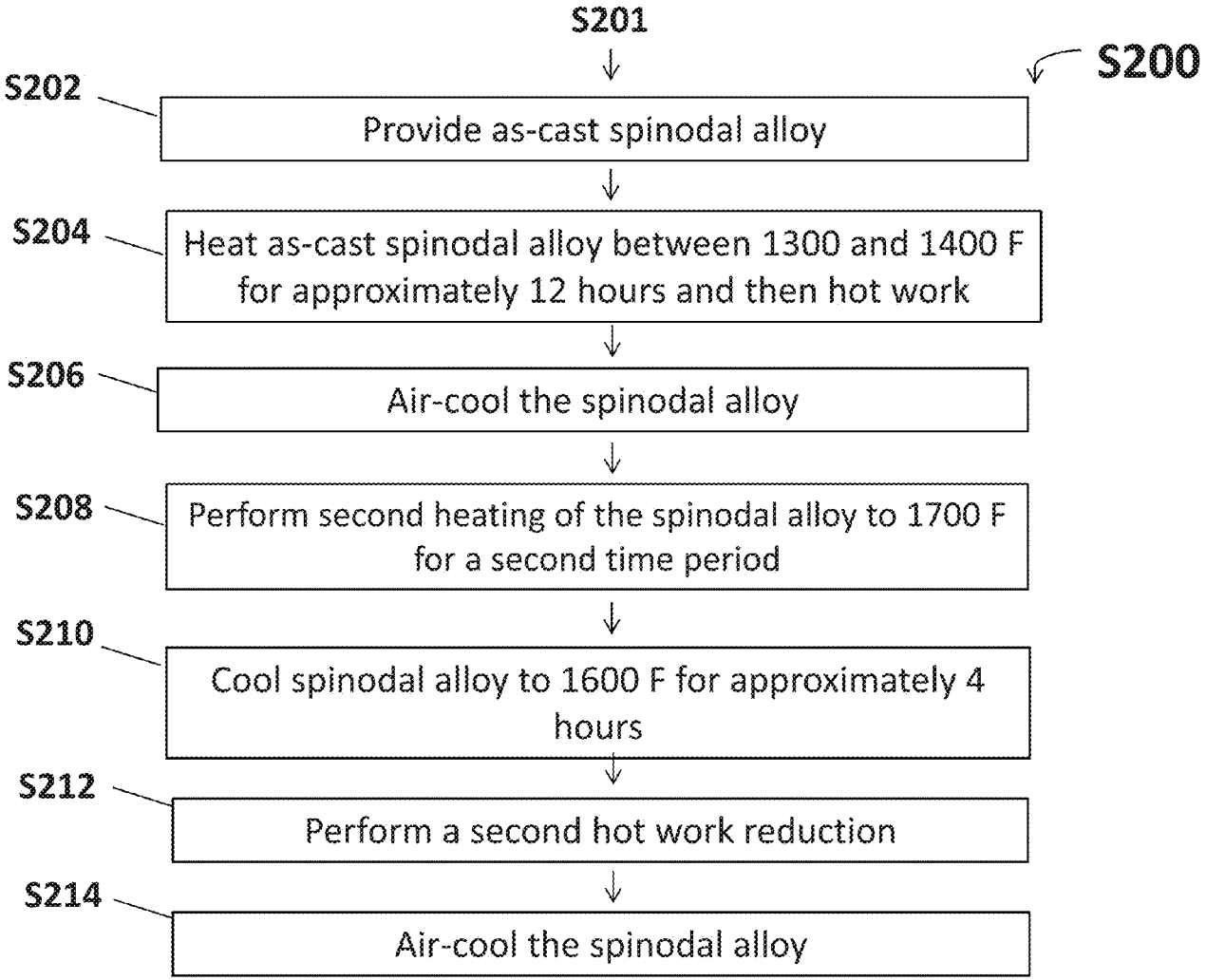
FIG. 2 is a flow chart for a second exemplary process of producing a hot worked spinodal alloy of uniform grain size.

With reference to FIG. 2, another exemplary process (S200) of producing spinodal alloy with uniform grain size by hot working according to a second embodiment starts at S201. At S202, an as-cast spinodal alloy is provided. At S204, the as-cast spinodal alloy is heated to between 1300° F. and 1400° F. for approximately 12 hours and then hot worked. At S206, the spinodal alloy is air-cooled. At S108, the spinodal alloy is heated a second time to a second temperature of 1700°

F. for a second time period. At S210, the spinodal alloy is cooled to a third temperature of 1600° F. for approximately 4 hours. At S212, a second hot work reduction is performed. At S214, the spinodal allow is air-cooled. A spinodal alloy with uniform grain size is formed without cracks and without homogenization being performed.

More generally, the processes illustrated in FIG. 1 and FIG. 2 are related to producing an article or alloy having uniform grain size. A casting is made from a spinodal alloy (S102, S202). The casting is heated to a first temperature of from about 1100° F. to about 1400° F. for a first time period of from about 10 hours to about 14 hours (S104, S204). A first hot work reduction of the casting is performed (S104, S204). The casting is then air-cooled to a first ambient temperature (S106, S206). The casting is then heated to a second temperature of at least 1600° F. for a second time period (S108, S208). The casting is then exposed to a third temperature for a third time period (S110, S210). This third temperature may be greater than or less than the second temperature. A second hot work reduction of the casting is performed (S112, S212), and the casting is air-cooled to a final ambient temperature to produce the article (S114, S214).

In embodiments similar to that of FIG. 1, the third temperature is least about 50° F. greater than the second temperature, and the third time period is from about 2 hours to about 6 hours.

In embodiments similar to that of FIG. 2, the third temperature is least about 50° F. lower than the second temperature, and the third time period is from about 2 hours to about 6 hours, and the casting is air cooled from the second temperature down to the third temperature.

It is noted that the temperatures referred to herein are the temperature of the atmosphere to which the alloy is exposed, or to which the furnace is set; the alloy itself does not necessarily reach these temperatures.

As discussed above, air cooling is used for the cooling steps of the processes described herein. In this regard, cooling of the alloy/casting can be performed by three different methods: water quenching, furnace cooling, and air cooling. In water quenching, the cast is submerged in water. This type of quenching quickly changes the temperature of the casting, and generally results in a single phase. In furnace cooling, the furnace is turned off with the casting left inside the furnace. As a result, the casting cools at the same rate as the air in the furnace. In air cooling, the casting is removed from the furnace and exposed to ambient temperature. If desired, air cooling can be active, i.e. ambient air is blown towards the casting. The casting cools at a faster rate under air cooling compared to furnace cooling.

The hot work reductions performed on the casting generally reduce the area of the casting by at least 30%. The degree of reduction can be determined by measuring the change in the cross-sectional area of the alloy before and after hot working, according to the following formula:

$$\% HW = 100 * [A_0 - A_f] / A_0$$

where $A_0$ is the initial or original cross-sectional area before hot working, and $A_f$ is the final cross-sectional area after hot working. It is noted that the change in cross-sectional area is usually due solely to changes in the thickness of the alloy, so the % HW can also be calculated using the initial and final thickness as well.

The copper alloy may be a spinodal alloy. Spinodal alloys, in most cases, exhibit an anomaly in their phase diagram called a miscibility gap. Within the relatively narrow temperature range of the miscibility gap, atomic ordering takes place within the existing crystal lattice structure. The resulting two-phase structure is stable at temperatures significantly below the gap.

Copper alloys have very high electrical and thermal conductivity compared to conventional high-performance ferrous, nickel, and titanium alloys. Conventional copper alloys are seldom used in demanding applications that require a high degree of hardness. However, copper-nickel-tin spinodal alloys combine high hardness and conductivity in both hardened cast and wrought conditions.

Furthermore, the thermal conductivity is three to five times that of conventional ferrous (tool steel) alloys, which increases heat removal rates while fostering reduction of distortion by dissipating heat more uniformly. Additionally, spinodal copper alloys exhibit superior machinability at similar hardnesses.

The copper alloy of the article may include nickel and/or tin. In some embodiments, the copper alloy contains from about 8 to about 20 wt % nickel and from about 5 to about 11 wt % tin, including from about 13 to about 17 wt % nickel and from about 7 to about 9 wt % tin, with the balance being copper. In specific embodiments, the alloy includes about 15 wt % nickel and about 8 wt % tin. In other embodiments, the alloy contains about 9 wt % nickel and about 6 wt % tin.

Ternary copper-nickel-tin spinodal alloys exhibit a beneficial combination of properties such as high strength, excellent tribological characteristics, and high corrosion resistance in seawater and acid environments. An increase in the yield strength of the base metal may result from spinodal decomposition in the copper-nickel-tin alloys.

Optionally, the alloy further includes beryllium, nickel, and/or cobalt. In some embodiments, the copper alloy contains from about 1 wt % to about 5 wt % beryllium and the sum of cobalt and nickel may be in the range of from about 0.7 wt % to about 6 wt %. In specific embodiments, the alloy includes about 2 wt % beryllium and about 0.3 wt % cobalt and nickel. Other copper alloy embodiments can contain a range of beryllium of between about 5 wt % and about 7 wt %.

The alloys of the present disclosure optionally contain small amounts of additives (e.g., iron, magnesium, manganese, molybdenum, niobium, tantalum, vanadium, zirconium, silicon, chromium, and any mixture of two or more elements thereof). The additives may be present in amounts of up to 5 wt %, including up to 1 wt % and up to 0.5 wt %.

In some embodiments, the preparation of the initial as cast alloy article includes the addition of magnesium. The magnesium may be added in order to reduce oxygen content. The magnesium may react with oxygen to form magnesium oxide which can be removed from the alloy mass.

The following examples are provided to illustrate the alloys, articles, and processes of the present disclosure. The examples are merely illustrative and are not intended to limit the disclosure to the materials, conditions, or process parameters set forth therein.

EXAMPLES

Figure 3:
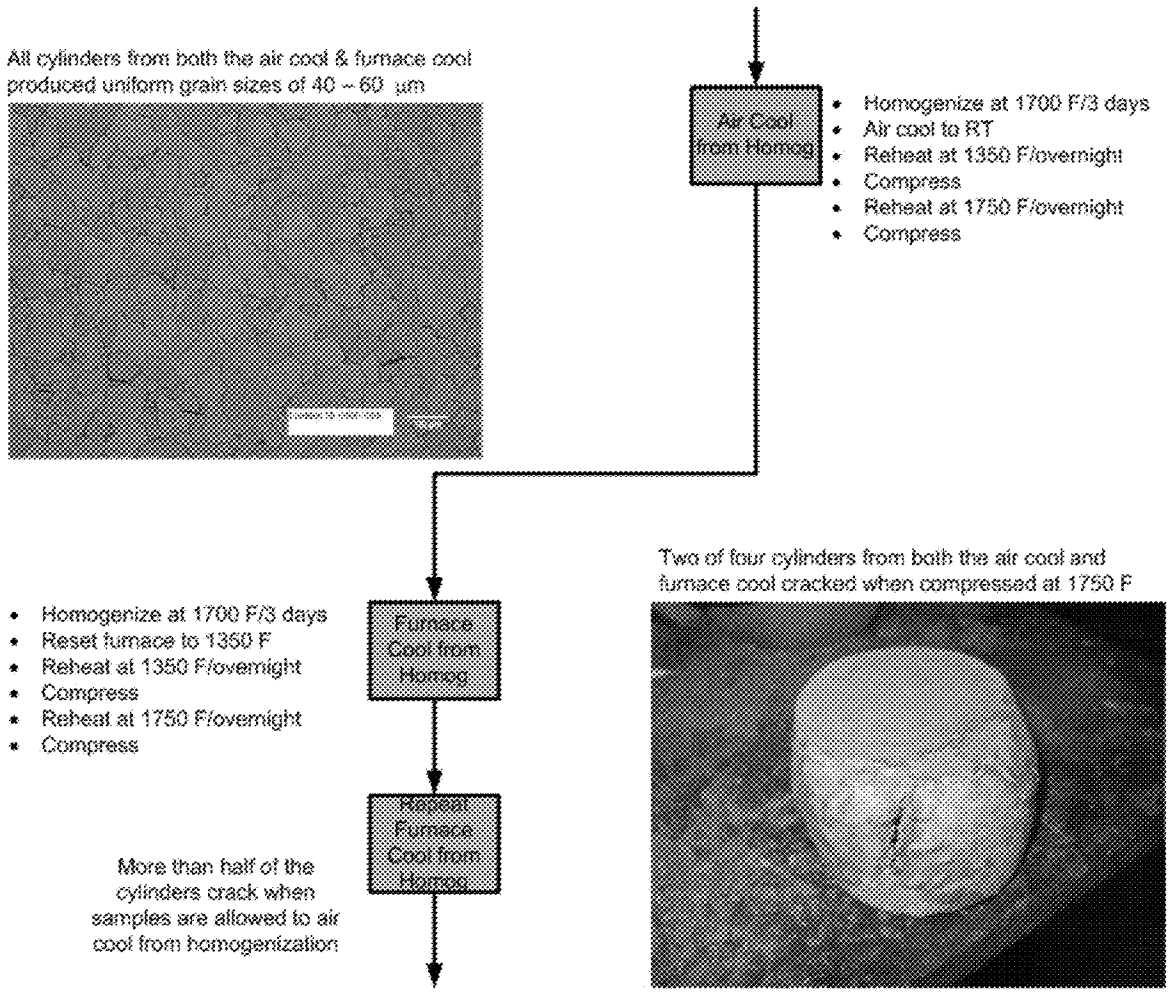
FIG. 3 is a flow chart of experimental data indicating that more than half of Cu—Ni—Sn spinodal alloy cylinders crack when subject to air cooling or furnace cooling at 1750 F under compression after homogenization is performed on the cylinders.

FIG. 3 is a chart describing some experiments performed on Cu—Ni—Sn spinodal alloy cylinders. All Cu—Ni—Sn spinodal alloys used were approximately 8-10 wt % nickel, 5-8 wt % tin, and the balance copper. Cooling methods were investigated here.

As described at the top right, some cylinders were homogenized at 1700° F. for three days, then air cooled to room temperature, reheated at 1350° F. overnight, compressed, reheated at 1750° F. overnight, and compressed. As described at the bottom left, some cylinders were homogenized at 1700°

F. for three days, then furnace cooled to 1350° F., reheated at 1350° F. overnight, compressed, reheated at 1750° F. overnight, and compressed.

In both cases, more than half of the cylinders cracked when compressed at 1750° F. However, both types of cooling produced uniform grain sizes between 40 micrometers (μm) and 60 μm, as seen in the upper left.

Figure 4:
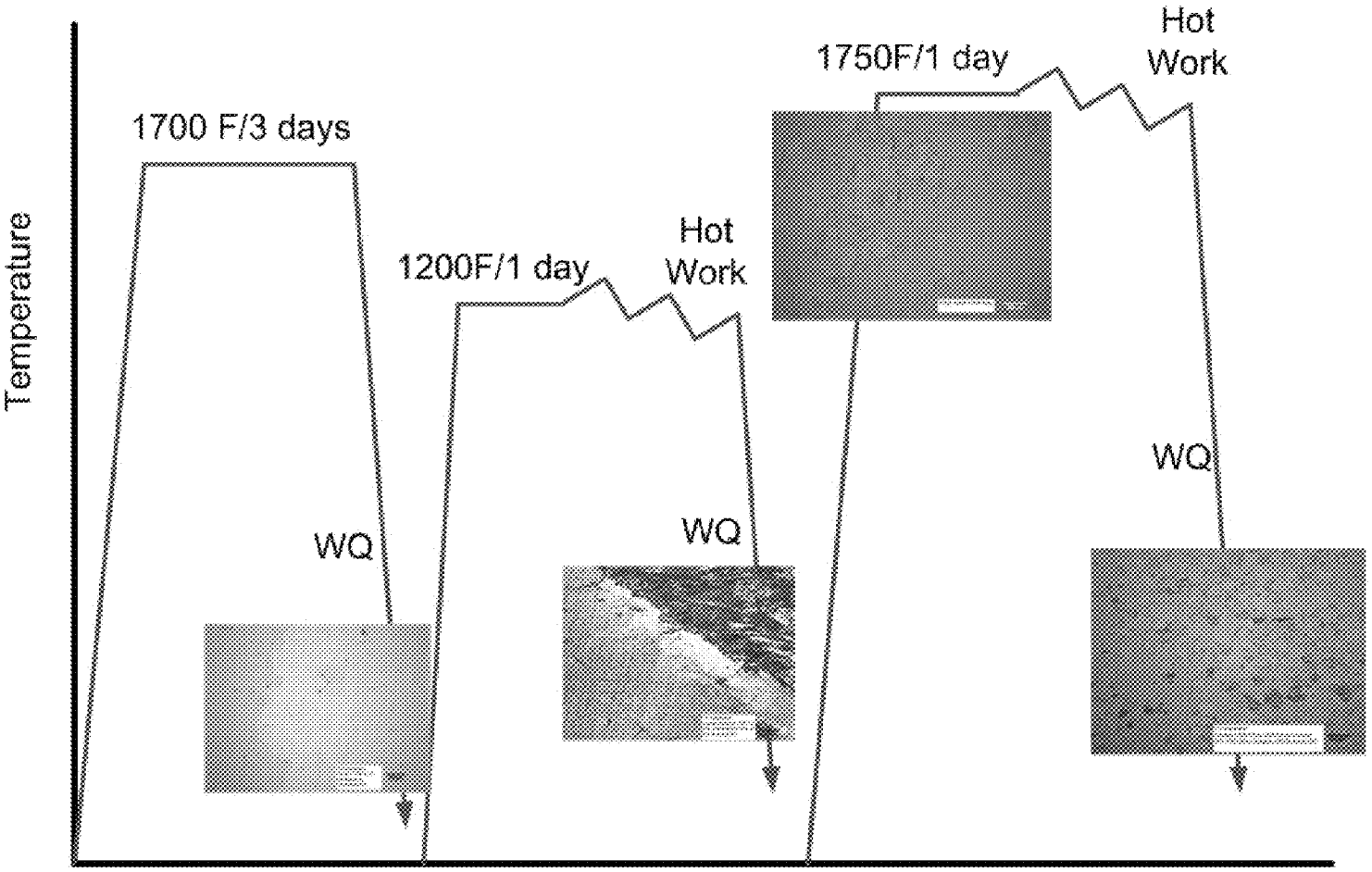
FIG. 4 is data graph showing a traditional process of (1) a homogenization step at 1700° F. for 3 days, (2) reheating at 1200° F. for 1 day and then hot working, and (3) a second reheating at 1750° F. for 1 day and a second hot working, where all three steps are followed by water quenching.

FIG. 4 is a data graph shows a traditional process of performing a (1) homogenization step at 1700° F. for 3 days, (2) a first reheat at 1200° F. for 1 day followed by hot working, and (3) a second reheat at 1750° F. for 1 day, followed by a second hot working. After each step (1-3), a WQ (water quench) was performed. The graph includes pictures illustrating the microstructure after the various steps. In comparing the results of FIG. 3 with FIG. 4, it was noted that the microstructure of the casting using air cooling after homogenization was similar to the as-cast microstructure.

Figure 5:
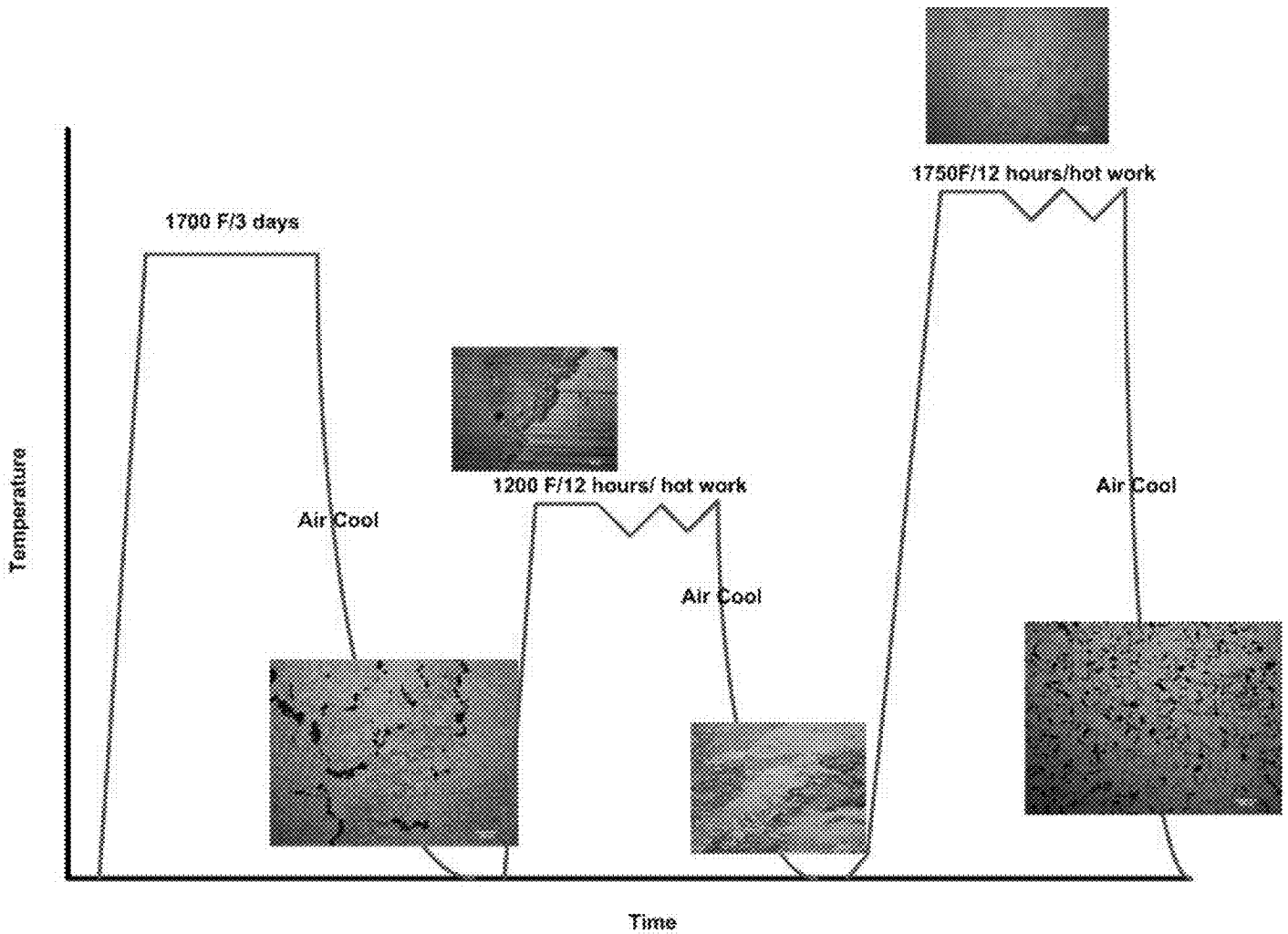
FIG. 5 is a data graph showing a modified procedure including the same steps (1-3) as used in FIG. 4, but using air cooling after each step instead of water cooling.

FIG. 5 is a data graph showing a modified procedure similar to FIG. 4, but using air cooling after each step instead of water quenching. While the microstructure data after the first homogenization step (1700° F./3 days) is quite different than that obtained in FIG. 4, the final microstructures were similar.

Figure 6:
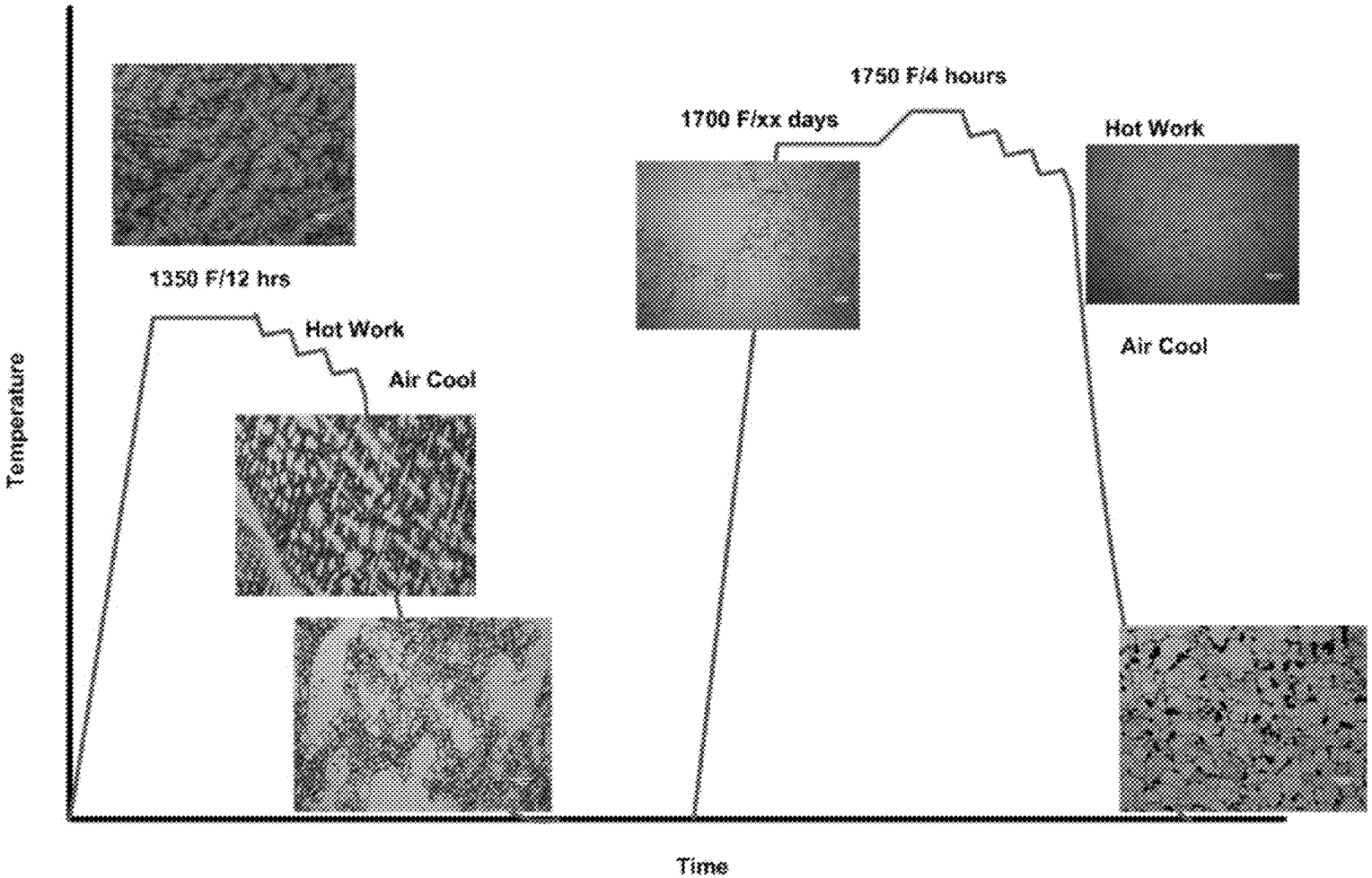
FIG. 6 is a data graph showing an exemplary process for forming spinodal alloys of uniform grain size. No homogenization step is present in this exemplary process.

As a result, the processes of the present disclosure were discovered. FIG. 6 is a data graph illustrating a first exemplary process for forming spinodal alloys with uniform grain size. The as-cast material was heated to 1350° F. for approximately 12 hours (microstructure shown at this point), hot worked, and then air cooled. Two microstructures are shown for the intermediate air cooled product (shown after air cooling caption on the first curve). The spinodal alloy material is then heated a second time to 1700° F. for a period of time (microstructure shown), e.g. at least 16 hours, and then to 1750° F. for 4 hours (microstructure shown) followed by a second hot working reduction and air cooling (microstructure shown). This process produced a uniform grain size, similar to the 40-60 μm grain size displayed in FIG. 3, without cracking and without a homogenization step.

Figure 7:
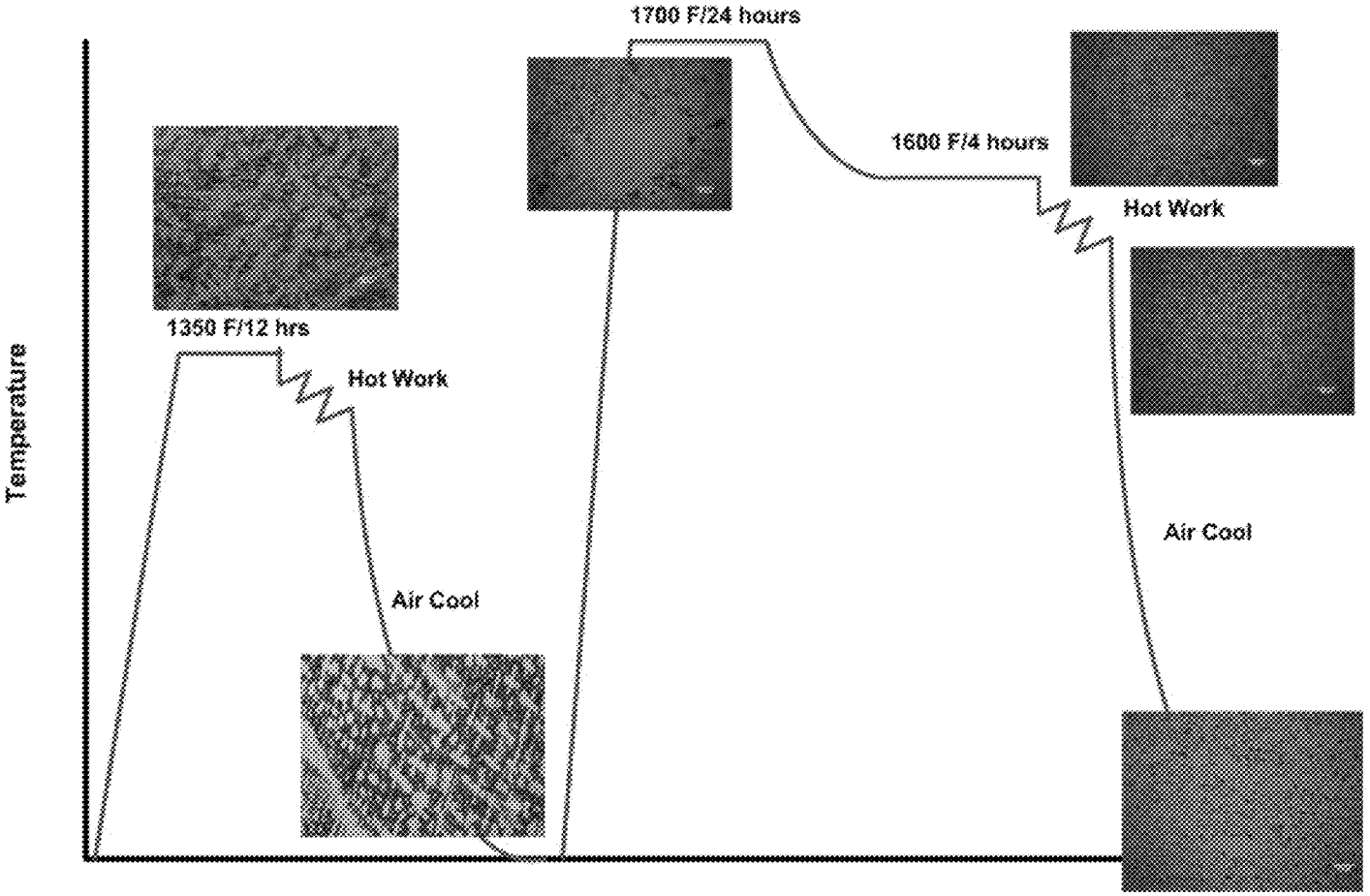
FIG. 7 is a data graph showing a second exemplary process for forming spinodal alloys of uniform grain size using a lower temperature during the second hot working.

FIG. 7 is a data graph illustrating a second exemplary process for forming spinodal alloys with uniform grain size. The as-cast material was heated to 1350° F. for approximately 12 hours (microstructure shown at this point), hot worked, and then air cooled. Two microstructures are shown for the intermediate air cooled product (shown after air cooling caption on the first curve). The spinodal alloy material is then heated a second time to a second temperature of 1700° F. for 24 hours. The to period of time (microstructure shown), e.g. at least 16 hours, and then to 1750° F. for 4 hours (microstructure shown) followed by a second hot working reduction and air cooling (microstructure shown). This process produced a uniform grain size, similar to the 40-60 μm grain size displayed in FIG. 3, without cracking and without a homogenization step.

With reference to FIG. 7, a data graph shows a second modified exemplary process for forming spinodal alloys of uniform grain size using a lower temperature second hot step. The input of this process is as-cast spinodal alloy material. The alloy was heated to 1350° F. for 12 hours (microstructure shown at this point), hot worked, and air cooled (microstructure shown). The material is then heated again to 1700° F. for 24 hours (non-uniform microstructure shown), then furnace cooled to 1600° F. and held for four hours (microstructure shown), hot worked (microstructure shown), and then air cooled (microstructure shown). This also produced a uniform microstructure without cracking and without a homogenization step. The final microstructure indicates an even finer grain size.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A process for producing an article comprising, in sequence:

heating a casting to a first temperature of from about 1100° F. to about 1400° F. for a first time period of from about 10 hours to about 14 hours, the casting comprising a spinodal alloy;

performing a first hot work reduction of the casting;

air cooling the casting to a first ambient temperature;

heating the casting to a second temperature of at least 1600° F. for a second time period;

exposing the casting to a third temperature for a third time period;

performing a second hot work reduction of the casting; and air cooling the casting to a final ambient temperature to produce the article.

2. The process of claim 1, wherein the third temperature is least about 50° F. greater than the second temperature, and the third time period is from about 2 hours to about 6 hours.

3. The process of claim 1, wherein the third temperature is least about 50° F. lower than the second temperature, and the third time period is from about 2 hours to about 6 hours, and the casting is furnace cooled from the second temperature down to the third temperature.

4. The process of claim 1, wherein the second temperature is from 1600° F. to about 1800° F.

5. The process of claim 1, wherein the second time period is from about 12 hours to about 48 hours.

6. The process of claim 1, wherein the third temperature is from about 1600° F. to about 1750° F.

7. The process of claim 1, wherein the third time period is about 4 hours.

8. The process of claim 1, wherein the process does not include a homogenization step.

9. The process of claim 1, wherein the first ambient temperature and the second ambient temperature are room temperature.

10. The process of claim 1, wherein the as-cast spinodal alloy is a copper-nickel-tin alloy.

11. The process of claim 10, wherein the copper-nickel-tin alloy comprises from about 8 to about 20 wt % nickel and from about 5 to about 11 wt % tin, with the balance being copper.

12. The process of claim 11, wherein the copper-nickel-tin as-cast spinodal alloy comprises from about 8 to about 10 wt % nickel and from about 5 to about 8 wt % tin.

13. The process of claim 1, wherein the first hot work reduction reduces the area of the casting by at least 30%.

14. The process of claim 1, wherein the second first hot work reduction reduces the area of the casting by at least 30%.

15. The process of claim 1, wherein the first temperature is from about 1200° F. to about 1350° F.

16. The process of claim 1, wherein the second temperature is from about 1650° F. to about 1750° F.

17. The process of claim 1, wherein the first time period is about 12 hours; and the first temperature is about 1350° F.

18. The process of claim 1, wherein the second time period is about 24 hours; and the second temperature is about 1700° F.

19. A process (S100) for producing a spinodal alloy with uniform grain size, comprising:

heating an as-cast spinodal alloy between 1300° F. and 1400° F. for approximately 12 hours and then hot work reducing the alloy;

air cooling the spinodal alloy;

heating the spinodal alloy to about 1700° F. for a time period of about 12 hours to about 48 hours;

heating the spinodal alloy to about 1750° F. for about 4 hours;

performing a hot work reduction; and air cooling the spinodal alloy to produce the spinodal alloy with uniform grain size.

20. A process (S200) for producing a spinodal alloy with uniform grain size, comprising:

heating an as-cast spinodal alloy between 1300° F. and 1400° F. for approximately 12 hours and then hot work reducing the alloy;

air cooling the spinodal alloy;

heating the spinodal alloy to about 1700° F. for a time period of about 12 hours to about 48 hours;

furnace cooling the spinodal alloy to about 1600° F. and heating for about 4 hours;

performing a hot work reduction; and air cooling the spinodal alloy to produce the spinodal alloy with uniform grain size.

* * * * *